US008141771B2

(12) United States Patent
Chen

(10) Patent No.: US 8,141,771 B2
(45) Date of Patent: Mar. 27, 2012

(54) PACKAGING CARTON BOX STRUCTURE

(75) Inventor: Yen-Hung Chen, Taipei (TW)

(73) Assignee: Pegatron Corporation, Taipei (TW)

( * ) Notice: Subject to any disclaimer, the term of this patent is extended or adjusted under 35 U.S.C. 154(b) by 371 days.

(21) Appl. No.: 12/547,055

(22) Filed: Aug. 25, 2009

(65) Prior Publication Data

US 2010/0051677 A1 Mar. 4, 2010

(30) Foreign Application Priority Data

Aug. 27, 2008 (TW) ..... 97132809 A

(51) Int. Cl.
*B65D 17/28* (2006.01)
*B65D 43/16* (2006.01)

(52) U.S. Cl. ..... 229/236; 229/125.08; 229/125.31; 229/178; 229/240

(58) Field of Classification Search ..... 229/125.08, 229/125.31, 125.32, 151, 152, 222, 236, 229/240

See application file for complete search history.

(56) References Cited

U.S. PATENT DOCUMENTS

| | | | | | |
|---|---|---|---|---|---|
| 2,387,325 | A | * | 10/1945 | Goodyear | 229/236 |
| 2,974,853 | A | * | 3/1961 | Struble | 229/222 |
| 3,270,947 | A | * | 9/1966 | Rasmussen | 229/222 |
| 3,510,047 | A | * | 5/1970 | Boehm et al. | 229/151 |
| 3,826,420 | A | * | 7/1974 | Bamburg et al. | 229/151 |
| 3,885,732 | A | * | 5/1975 | Foster | 229/222 |
| 3,886,901 | A | * | 6/1975 | Zeitter | 229/152 |
| 3,949,931 | A | * | 4/1976 | Hall | 229/178 |
| 4,339,041 | A | * | 7/1982 | Roberts et al. | 229/222 |
| 4,645,108 | A | * | 2/1987 | Gavin et al. | 229/178 |
| 4,679,694 | A | * | 7/1987 | Donohie et al. | 229/236 |
| 4,787,515 | A | * | 11/1988 | Stoll | 229/125.31 |
| 5,330,099 | A | | 7/1994 | Beales et al. | |
| 5,447,225 | A | * | 9/1995 | Gunn et al. | 229/125.32 |
| 2005/0199695 | A1 | * | 9/2005 | DeBusk et al. | 229/222 |
| 2005/0218202 | A1 | * | 10/2005 | Braoudakis | 229/178 |
| 2007/0181658 | A1 | | 8/2007 | Sutherland | |

FOREIGN PATENT DOCUMENTS

| | | | |
|---|---|---|---|
| CN | 2542579 | Y | 4/2003 |
| CN | 2740537 | Y | 11/2005 |
| CN | 1867491 | A | 11/2006 |
| CN | 2918233 | Y | 7/2007 |
| CN | 2936944 | Y | 8/2007 |
| CN | 200945956 | Y | 9/2007 |
| JP | 2004043034 | A | 2/2004 |

(Continued)

OTHER PUBLICATIONS

English translation of abstract of TW 200613195, May 2006.

(Continued)

*Primary Examiner* — Gary Elkins

(74) *Attorney, Agent, or Firm* — Thomas, Kayden, Horstemeyer & Risley, LLP

(57) ABSTRACT

A packaging carton box structure includes a first sheet and a second sheet, and a pre-tearing portion is disposed on a first side plate of the first sheet. After the first sheet and the second sheet are bent, an object is packaged, and then, after the packaged object is placed on a placement plane, the pre-tearing portion is torn, so as to take out the object along a direction parallel to the placement plane, which is time-saving and labor-saving, and further prevents the object from falling off to result in damages when being taken out.

15 Claims, 9 Drawing Sheets

FOREIGN PATENT DOCUMENTS

| | | |
|---|---|---|
| JP | 2006-182366 | 7/2006 |
| TW | 592206 | 6/2004 |
| TW | 200613195 | 5/2006 |
| WO | 03022693 A1 | 3/2003 |

OTHER PUBLICATIONS

English translation of abstract of CN 2542579 Y, Apr. 2003.
English translation of abstract of JP 2006-182366, Jul. 2006.
English language translation of abstract of 592206, Jun. 2004.
English language translation of abstract of 2918233, Jul. 2007.
English language translation of abstract of 2740537, Nov. 2005.
English translation of abstract of CN 1867491 A, Nov. 2006.
English translation of abstract of CN 200945956 Y, Sep. 2007.
English translation of abstract of CN 2936944 Y, Aug. 2007.
English translation of abstract of JP 2004043034 A, Feb. 2004.

* cited by examiner

PACKAGING CARTON BOX STRUCTURE

CROSS-REFERENCES TO RELATED APPLICATIONS

This non-provisional application claims priority under 35 U.S.C. §119(a) on Patent Application No. 97132809 filed in Taiwan, R.O.C. on 2008/8/27, the entire contents of which are hereby incorporated by reference

BACKGROUND

1. Technical Field

The present invention relates to a packaging carton box, and more particularly to a packaging carton box structure, which enables an object accommodated therein to be conveniently taken out.

2. Related Art

For a common carton box used to package an object, mostly a paperboard or a planar packaging material with an appropriate thickness is bent and then bound up to form a hollow hexahedral box, and then an object to be packaged is placed in the box, and a buffer material made of Styrofoam, sponge, and other foaming materials is inserted in the box to protect the object within the box, so as to further perform transporting, storing, selling, or other operations.

When the packaged object has a large volume or is rather heavy, during disassembly, firstly the packaging material and the object must be together uplifted and moved to a predetermined position. Then, the carton box is opened, and the object is uplifted out of the carton box in a direction vertical to the ground. However, the object has a large volume and is rather heavy, and the buffer material used to wrap the object is tightly attached to the carton box, such that it is difficult to take out the object, which is not only time-consuming and labor-consuming, but also requires the cooperation of many people to take out the object from the carton box. Furthermore, during the process of taking out the object, the object may fall off to result in damages.

SUMMARY

In view of the above, the present invention provides a packaging carton box structure, which includes a first sheet and a second sheet. The first sheet includes a first substrate, two first side plates, two first extending plates, and a plurality of first joining plates. The first substrate has two first side edges and two second side edges. The two first side edges are respectively connected to the first side plates. The first side plates have pre-tearing portions respectively, and may be bent to form inserting portions. The two second side edges are respectively connected to the first extending plates that may be bent towards the first substrate. The plurality of first joining plates is connected to the two first extending plates, and after the first extending plates are bent towards the first substrate, the first joining plates are respectively inserted into the inserting portions. The second sheet includes a second substrate and two second extending plates. The second substrate has two third side edges and two fourth side edges. The two fourth side edges are respectively connected to the second extending plates that may be bent towards the second substrate. The two second extending plates are respectively positioned on the two first extending plates, such that the second sheet covers the first sheet to form an accommodation space. After the pre-tearing portions are torn, the plurality of first joining plates is released from the inserting portions, so as to unfold the first sheet.

The present invention also provides a packaging carton box structure, which includes a first substrate, two first side plates, two first extending plates, a plurality of first joining plates, a second substrate, and a second extending plate. The first substrate has two first side edges and two second side edges. The two first side edges are respectively connected to the first side plates. The first side plates have pre-tearing portions respectively, and may be bent to form inserting portions. The two second side edges are respectively connected to the first extending plates that may be bent towards the first substrate. The plurality of first joining plates is connected to the two first extending plates, and after the first extending plates are bent towards the first substrate, the first joining plates are respectively inserted into the inserting portions. The second substrate is connected to the first extending plates, and has two third side edges and two fourth side edges, in which one of the fourth side edges is respectively connected to the second extending plate that may be bent towards the second substrate. The second extending plate is positioned on the first extending plate, such that the second substrate, the second extending plate, and the two first extending plates cover the first substrate to form an accommodation space. After the pre-tearing portions are torn, the plurality of first joining plates is released from the inserting portions, so as to unfold the first substrate.

After an object is packaged and then placed on a placement plane in the present invention, a user simply needs to tear off the pre-tearing portions, such that the first substrate is opened outwards and unfolded, and the user is enabled to take out the object having a large volume and being heavier along a direction parallel to the placement plane, thereby solving the problems in the prior art that when a packaging carton box is used to package an object having a large volume and being heavier, the object having the large volume and being heavier cannot be taken out unless the object is strenuously uplifted or the forces are applied by many people cooperatively.

DETAILED DESCRIPTION

Referring to FIGS. 1A, 1B, 2, and 3, a packaging carton box structure according to a first embodiment of the present invention is shown. The packaging carton box structure includes a first sheet 10 and a second sheet 30.

Figure 1A:
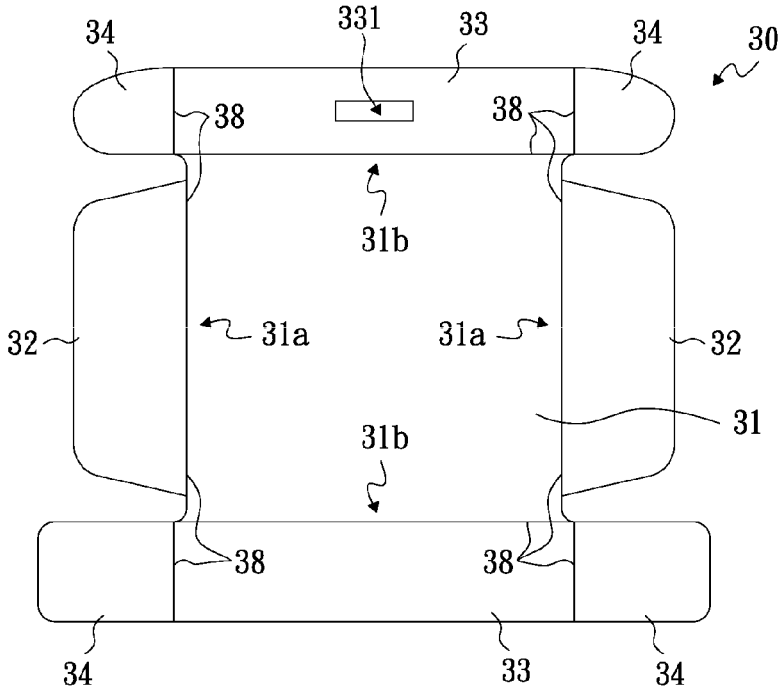
FIG. 1A is a plan view (1) of a first embodiment of the present invention.
Figure 1B:
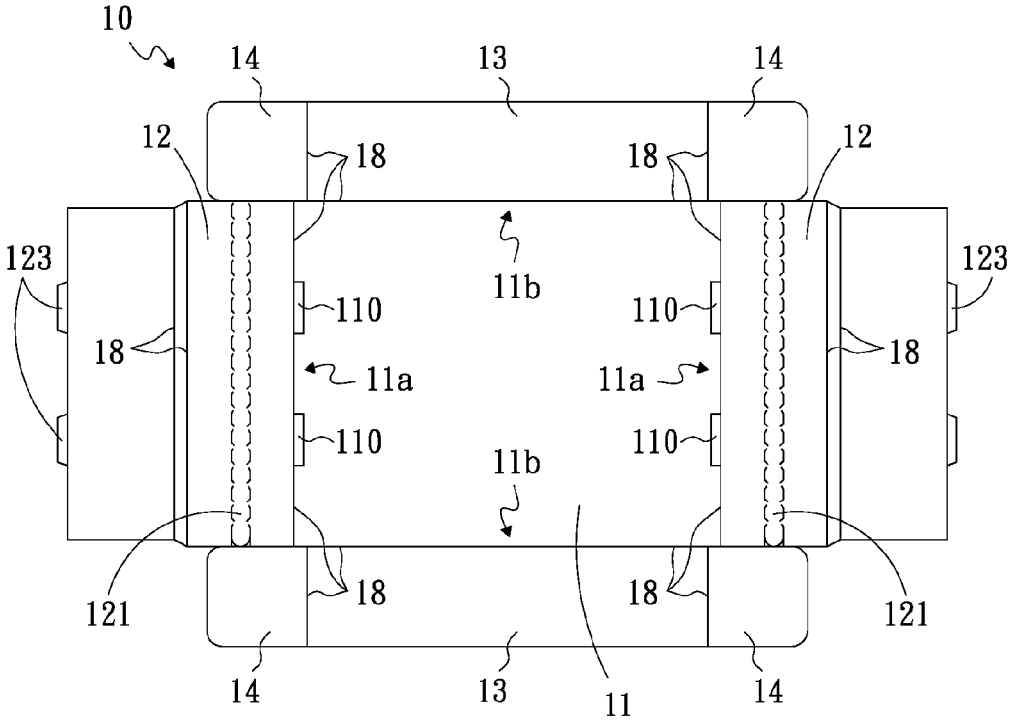
FIG. 1B is a plan view (2) of the first embodiment of the present invention.
Figure 2:
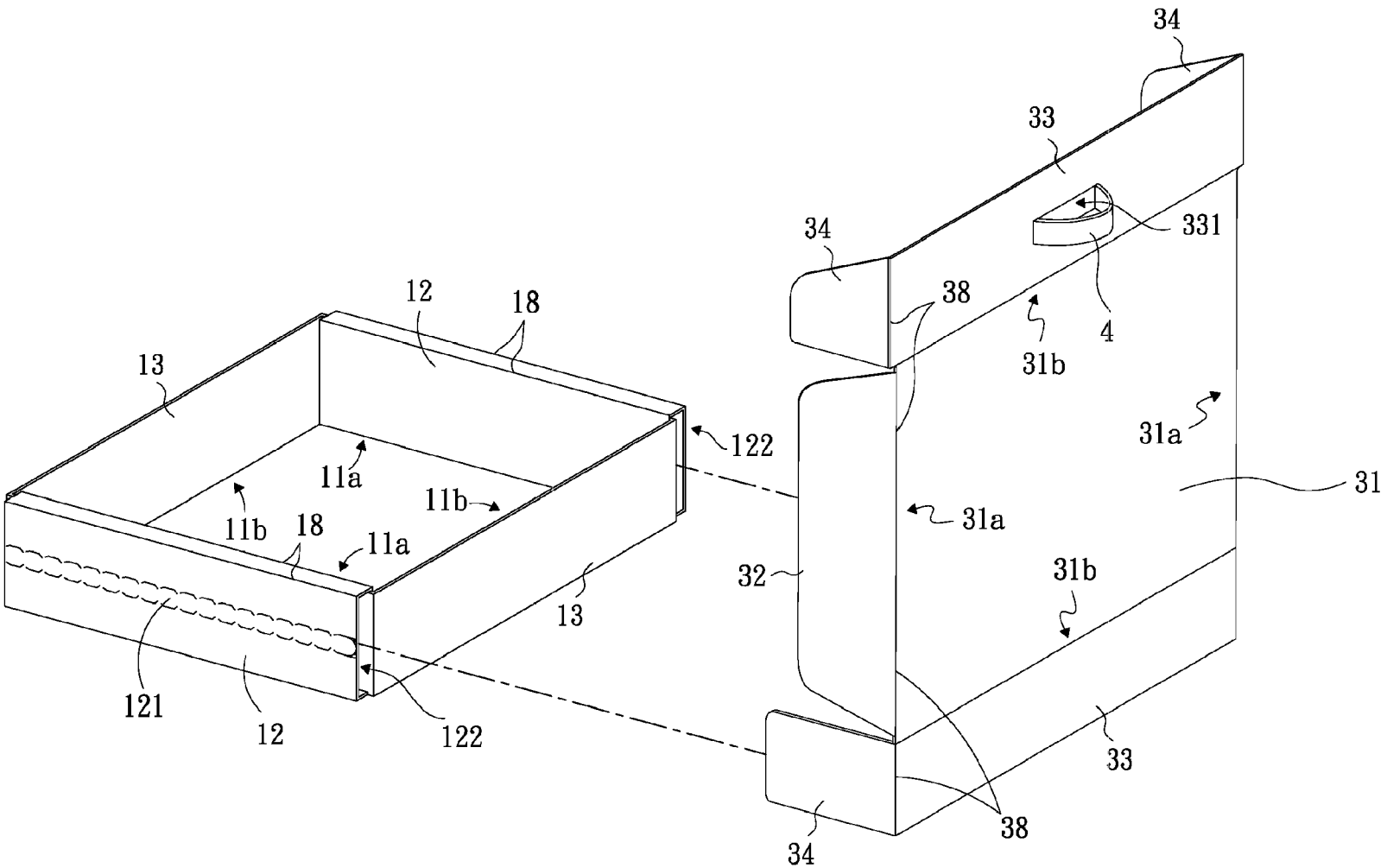
FIG. 2 is a schematic view of the first embodiment of the present invention during assembly.

The first sheet 10 includes a first substrate 11, two first side plates 12, two first extending plates 13, and a plurality of first joining plates 14. The first substrate 11 is approximately rectangular, and has two first side edges 11*a* and two second side edges 11*b* approximately vertical to each other. Openings 110 are disposed at appropriate positions on the two first side edges 11*a*. The two first side edges 11*a* are respectively connected to the first side plates 12, and the first side plates 12 have pre-tearing portions 121 and may be bent to form inserting portions 122. In addition, protruding portions 123 corresponding to the openings 110 are respectively extended on one side edge of each first side plate 12 that is not connected to the first substrate 11. After the first side plates 12 are bent, the protruding portions 123 are embedded into the corresponding openings 110. The two second side edges 11*b* are respectively connected to the first extending plates 13, and each of the first extending plates 13 is connected to the plurality of first joining plates 14. After the first extending plates 13 are bent towards the first substrate 11, the plurality of first joining plates 14 is respectively inserted into the inserting portions 122, such that the first sheet 10 is approximately configured into a box body (as shown in FIG. 2).

In the above description, the pre-tearing portions 121 may be formed by a plurality of piercing points or cutting lines, and may be disposed merely on one of the first side plates 12, or may be disposed on each of the first side plates 12.

Figure 3:
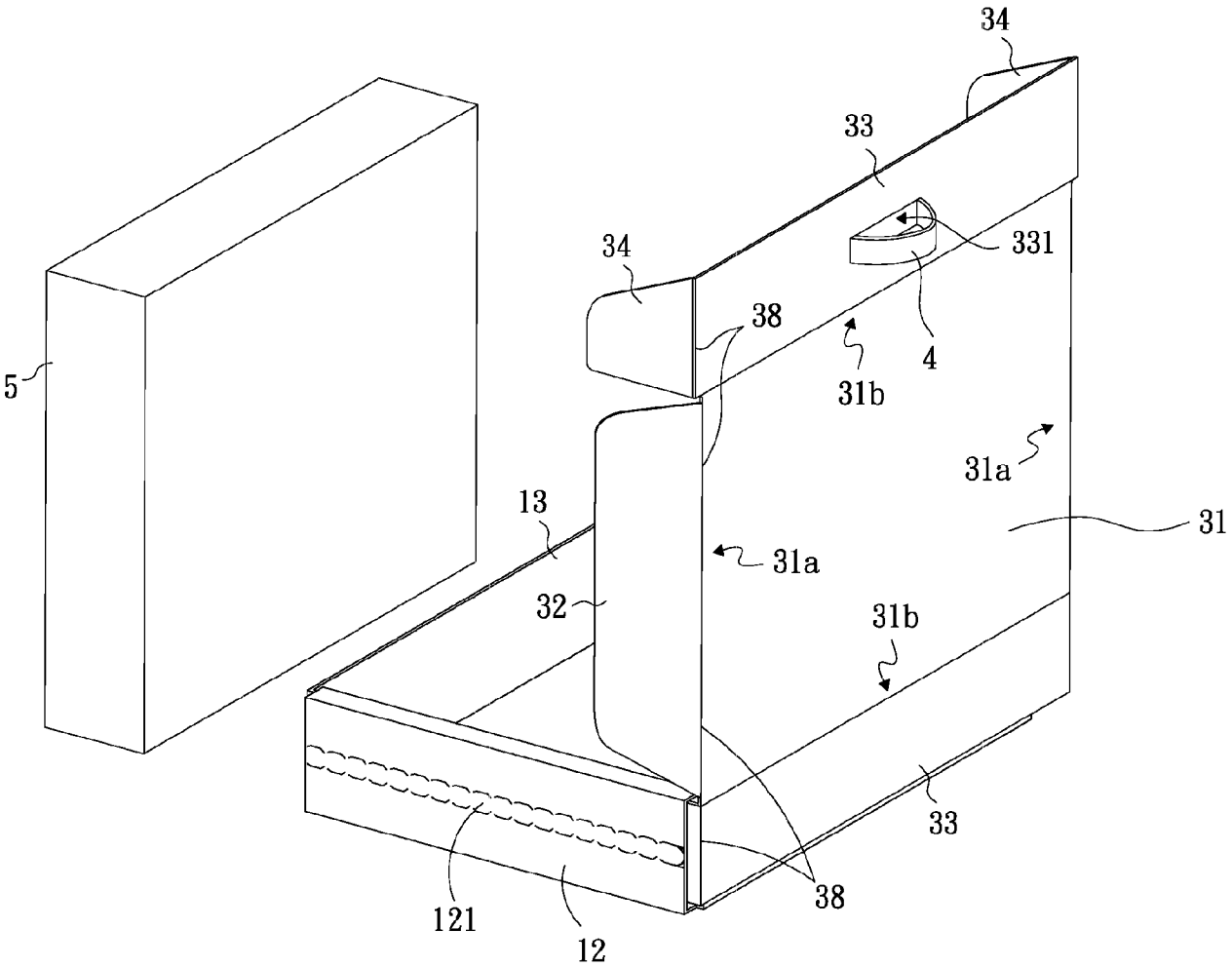
FIG. 3 is a schematic view of the first embodiment of the present invention after assembly.

The second sheet 30 includes a second substrate 31, two second side plates 32, two second extending plates 33, and a plurality of second joining plates 34. The second substrate 31 is approximately rectangular, and has two third side edges 31*a* and two fourth side edges 31*b* approximately vertical to each other. The two third side edges 31*a* are respectively connected to the second side plates 32 that may be bent towards the second substrate 31. The two fourth side edges 31*b* are respectively connected to the second extending plates 33 that may be bent towards the second substrate 31. After the second side plates 32 and the second extending plates 33 are bent towards the second substrate 31, the second sheet 30 is approximately configured into a cover. The plurality of second joining plates 34 is connected to two ends of the second extending plates 33. After the second extending plates 33 are bent towards the second substrate 31, the second joining plates 34 on the two ends of the second extending plates 33 are respectively inserted into the inserting portions 122 on two sides of the first substrate 11, thereby combining the first sheet 10 with the second sheet 30, such that the second sheet 30 covers the first sheet 10 to form an accommodation space, and an object 5 is accommodated in the accommodation space (as shown in FIG. 3).

In addition, a plurality of first bending lines 18 is disposed on the first sheet 10. The first bending lines 18 are respectively located between the first substrate 11 and each of the first side plates 12, between the first substrate 11 and each of the first extending plates 13, and between the first extending plates 13 and each of the first joining plates 14, such that the first side plates 12 and the first extending plates 13 are bent towards the first substrate 11 along the first bending lines 18, and the first joining plates 14 are bent towards the first extending plates 13 along the first bending lines 18, so as to be inserted into the inserting portions 122. A plurality of second bending lines 38 is disposed on the second sheet 30. The second bending lines 38 are located between the second substrate 31 and each of the second side plates 32, between the second substrate 31 and each of the second extending plates 33, and between the second extending plates 33 and each of the second joining plates 34, such that the second side plates 32 and the second extending plates 33 are bent towards the second substrate 31 along the second bending lines 38, and the second joining plates 34 are bent towards the second extending plates 33 along the second bending lines 38, so as to be inserted into the inserting portions 122. Furthermore, in the present invention, a holding portion 4 is disposed on one of the second extending plates 33, and preferably, an opening 331 is disposed in the second extending plate 33, such that the holding portion 4 passes through the opening, which thus can be conveniently carried by the user.

Figure 4B:
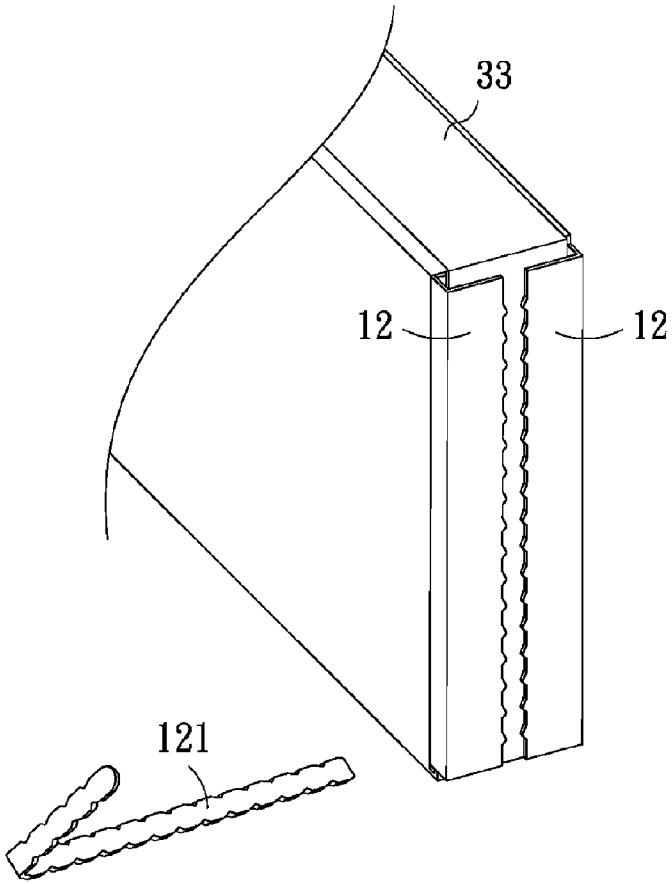
FIG. 4B is a schematic view (2) of the first embodiment of the present invention when taking out an object.
Figure 4A:
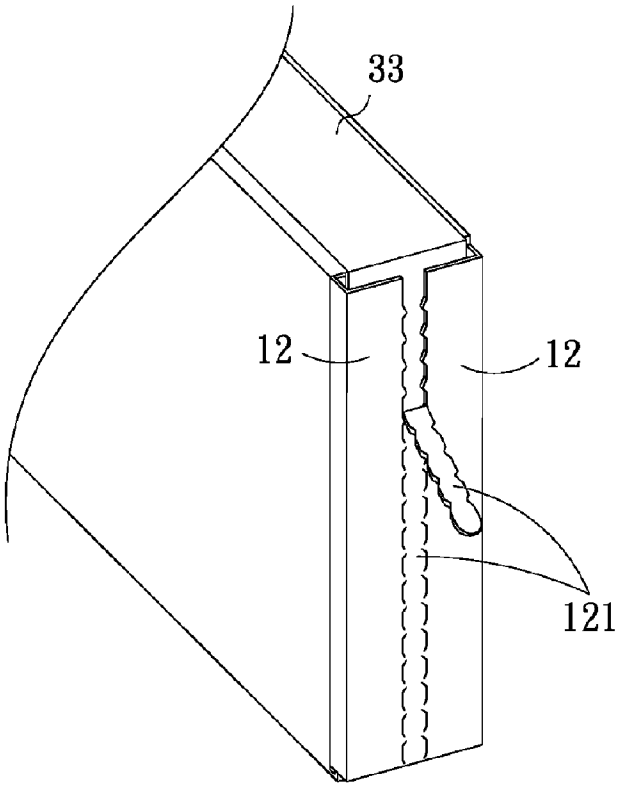
FIG. 4A is a schematic view (1) of the first embodiment of the present invention when taking out an object.
Figure 4C:
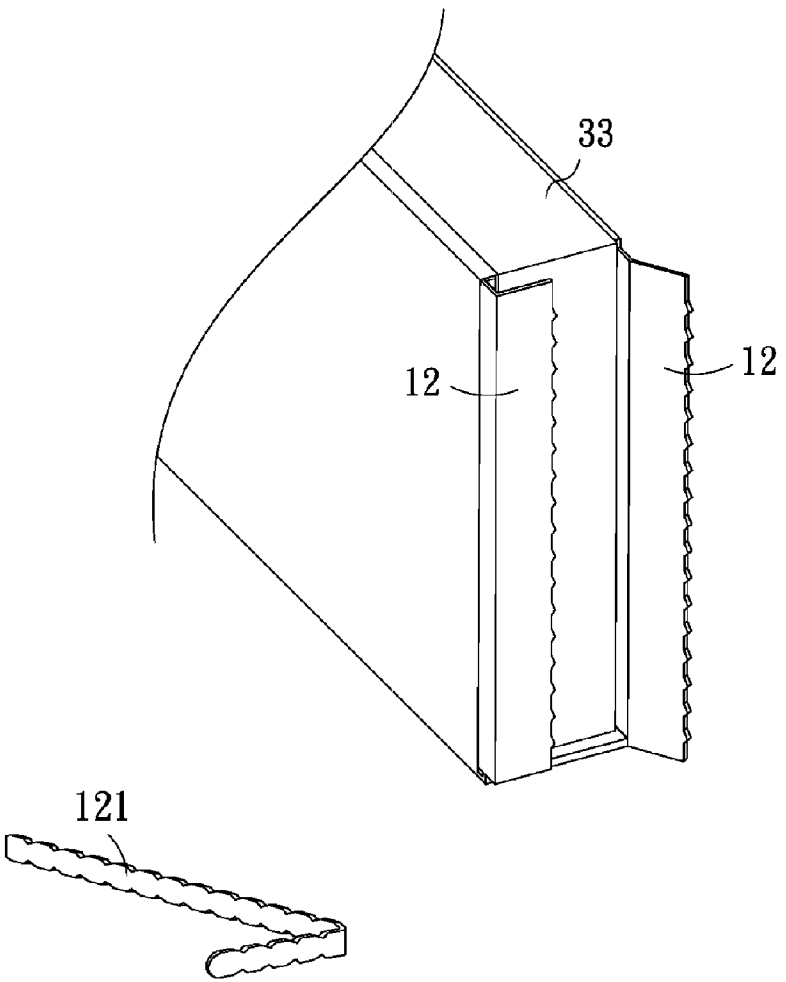
FIG. 4C is a schematic view (3) of the first embodiment of the present invention when taking out an object.
Figure 5:
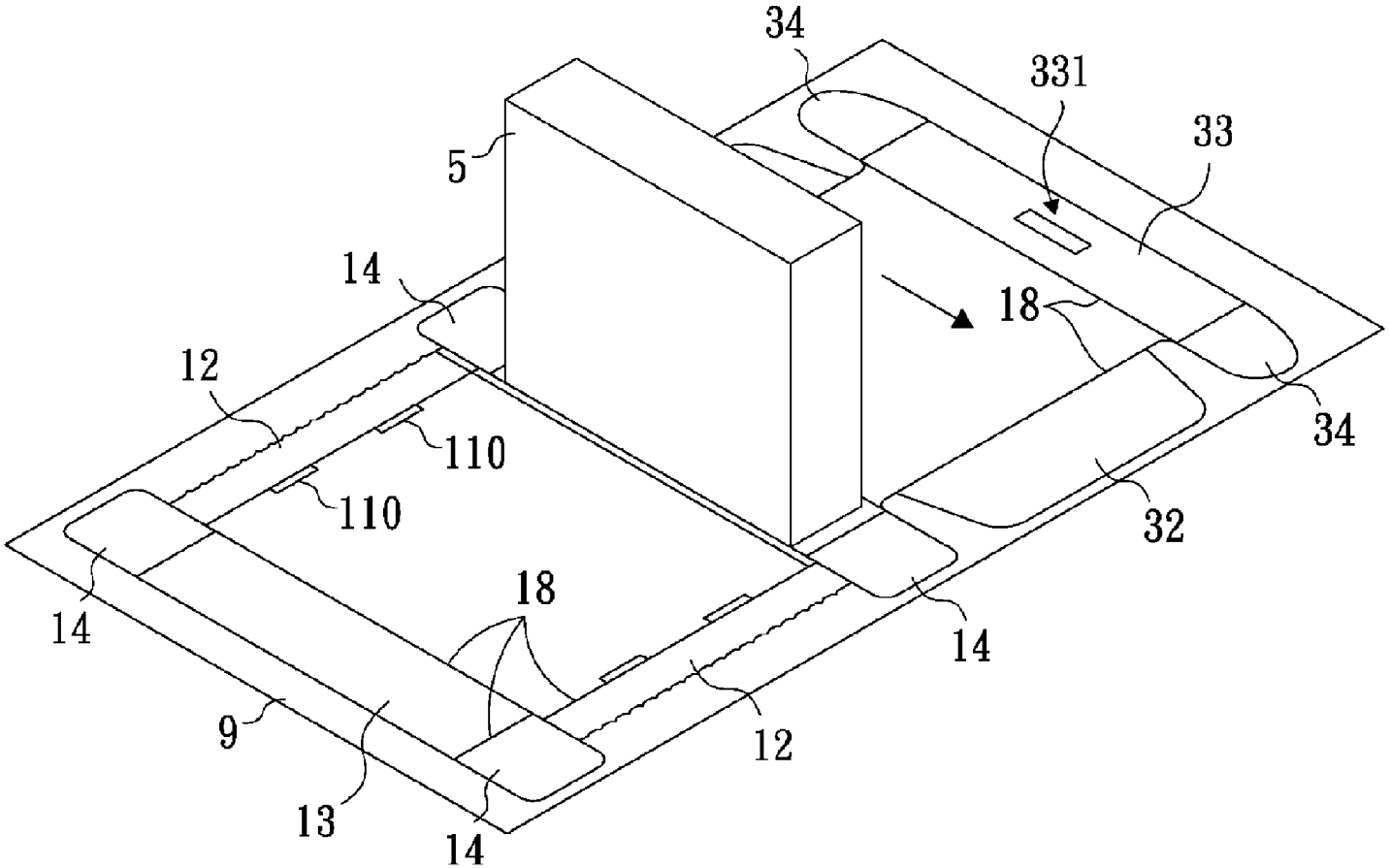
FIG. 5 is a schematic view of the first embodiment of the present invention when two sheets are unfolded.

Referring to FIGS. 4A, 4B, and 4C, after packaging the object 5 by using the packaging carton box structure according to the present invention, the user moves the packaging carton box structure together with the object 5 accommodated therein to a placement plane 9 at a predetermined position. After the structure is stably placed, the first side plates 12 are torn along the pre-tearing portions 121, and the first substrate 11 and the second substrate 31 are pulled outwards, such that the first joining plates 14 and the second joining plates 34 are separated from the inserting portions 122, such that the first sheet 10 and the second sheet 30 are opened outwards and unfolded (as shown in FIG. 5). In this manner, the user may take out the object 5 having a large volume and being heavier in a direction parallel to the placement plane 9, that is, the user applies a force to push or pull the object 5 to parallelly move out of the packaging carton box structure, without strenuously uplifting the object having a large volume and being heavier out of the carton box, thereby preventing the object 5 from falling off when being taken out to result in damages.

In addition, when the packaging carton box structure of the present invention is placed on the placement plane 9, besides placing the packaging carton box structure to be upright on the placement plane 9 by enabling the first extending plates 13 and the second extending plates 33 to be attached to the placement plane 9, the user may place the packaging carton box structure to lie on the placement plane 9 by enabling the first substrate 11 or the second substrate 31 to be attached to the placement plane 9. In this case, after the pre-tearing portions 121 are torn off, the first sheet 10 and the second sheet 30 are opened outwards and unfolded, and the object 5 is taken out in a direction parallel to the first substrate 11 or the second substrate 31.

Figure 6A:
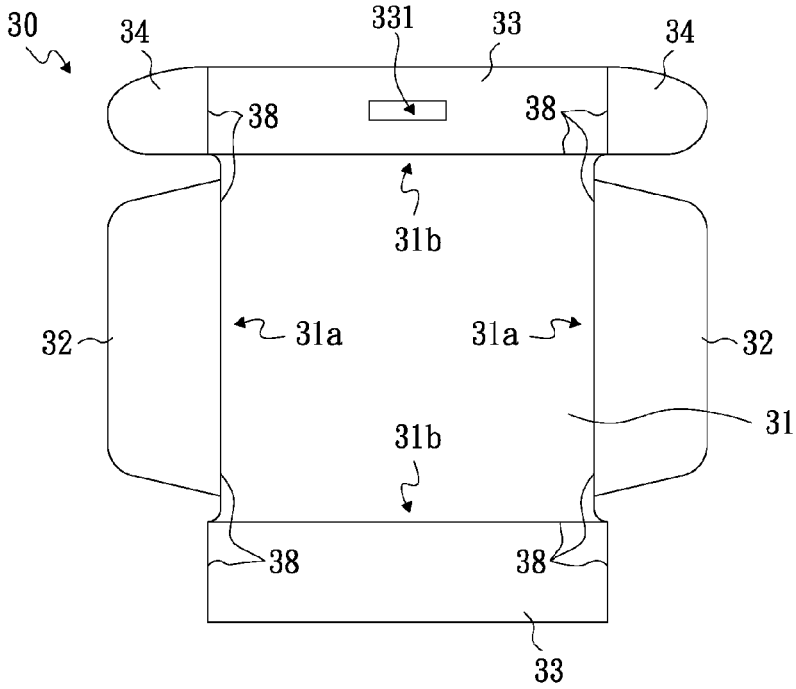
FIG. 6A is a plan view (1) of a second embodiment of the present invention.
Figure 6B:
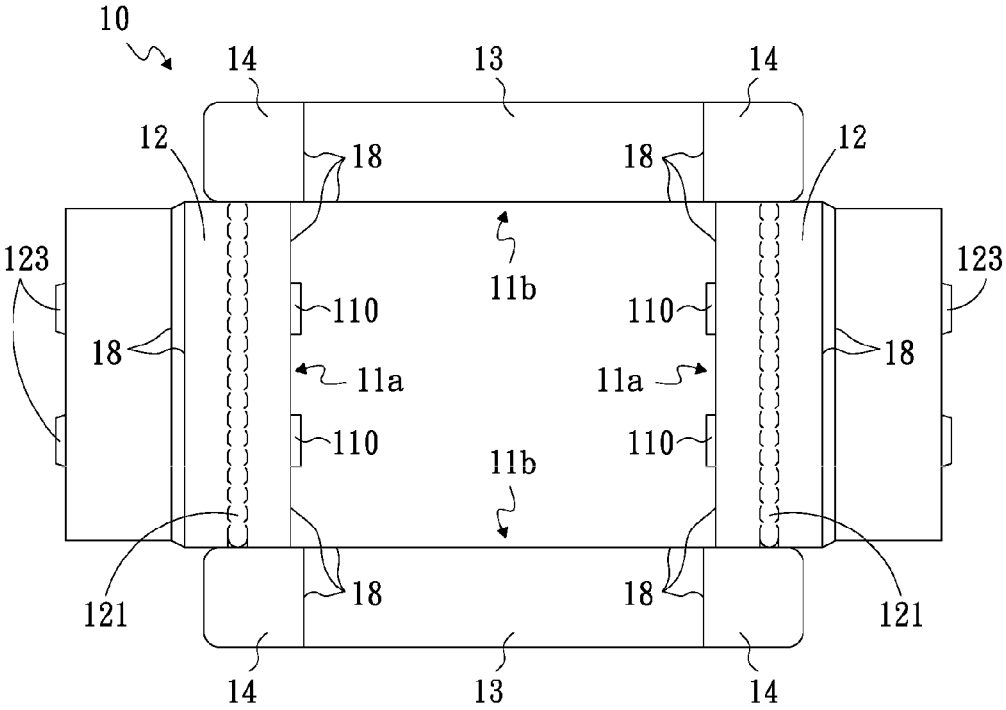
FIG. 6B is a plan view (2) of the second embodiment of the present invention.
Figure 7:
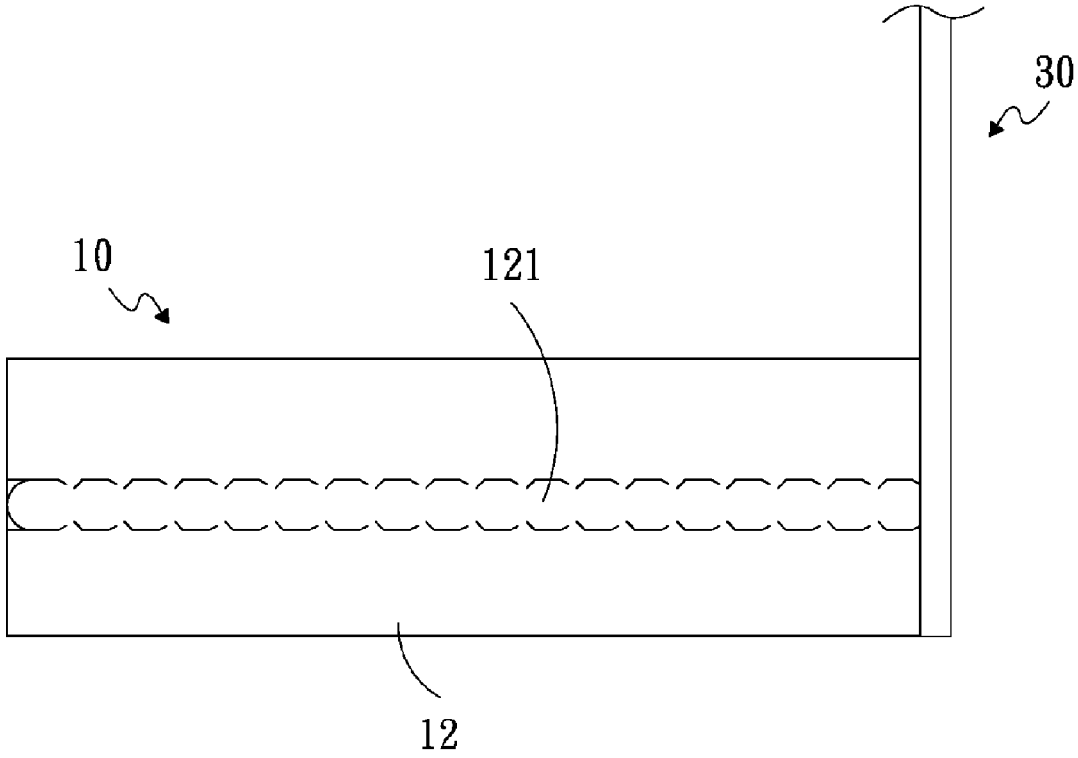
FIG. 7 is a schematic view of the second embodiment of the present invention after assembly.

Referring to FIGS. 6A, 6B, and 7, a packaging carton box structure according to a second embodiment of the present invention is shown. In this embodiment, no second joining plate 34 is extended on one of the second extending plates 33 of the second sheet 30. Instead, the second extending plate 33 is positioned on the first extending plate 13 of the first sheet 10 in an adhesion manner, thereby combining the first sheet 10 with the second sheet 30, such that the second sheet 30 covers the first sheet 10 to form the accommodation space. Here, the second extending plate 33 is adhered to the first extending plate 13 by using glue or hook-and-loop fasteners, but the present invention is not limited here.

Figure 8:
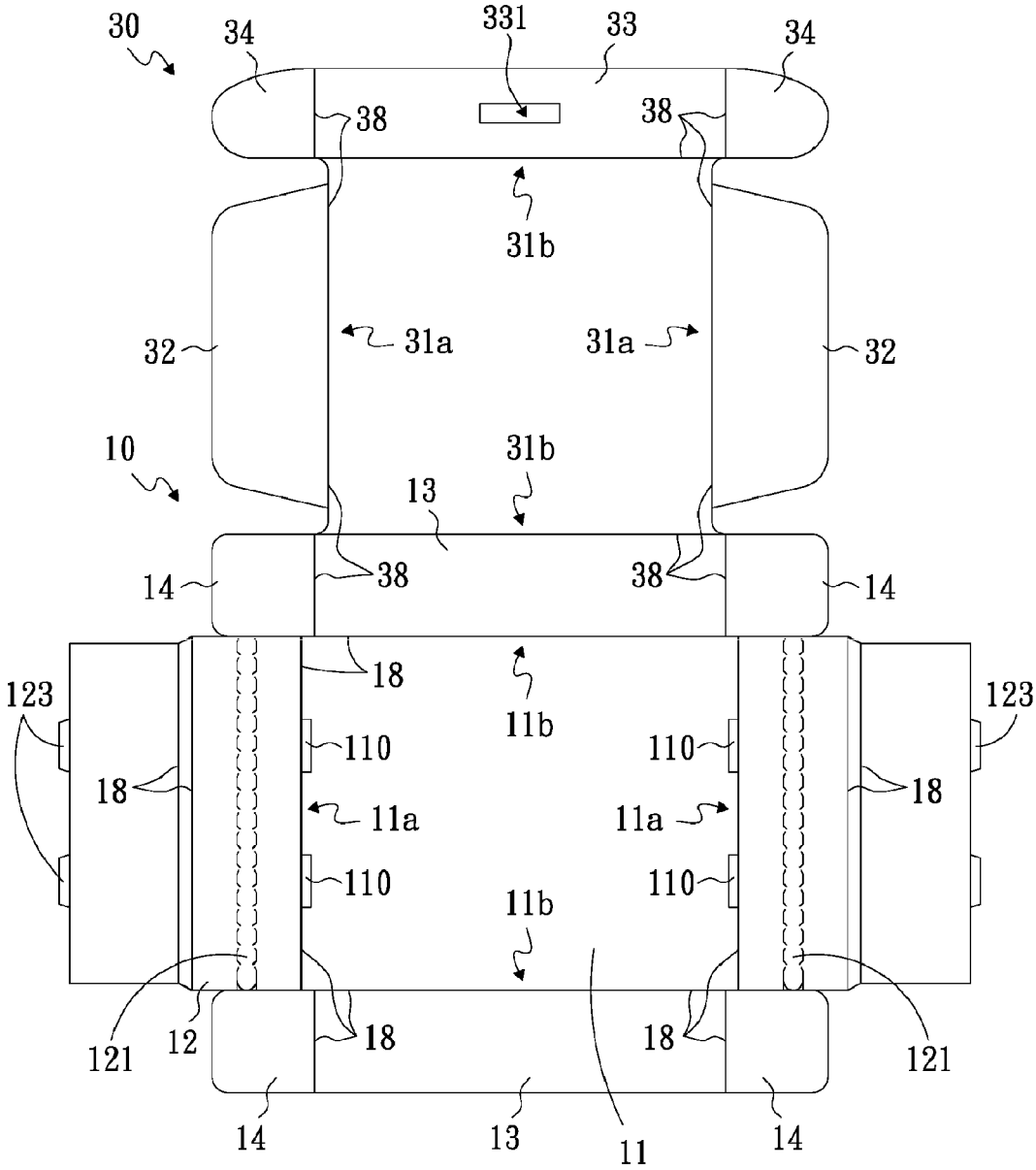
FIG. 8 is a plan view of a third embodiment of the present invention.

Referring to FIG. 8, a packaging carton box structure according to a third embodiment of the present invention is shown. As compared with the first embodiment and the second embodiment, this embodiment does not have a structure with the first sheet 10 and the second sheet 30 as two separated elements, but the first sheet 10 and the second sheet 30 are integrally formed. Specifically, the two first side edges 11*a* of the first substrate 11 are respectively connected to the first side plates 12, the two second side edges 11*b* thereof are respectively connected to the first extending plates 13, and one of the first extending plates 13 is connected to the fourth side edge 31*b* of the second substrate 31. The first substrate 11, the two first side plates 12, the two first extending plates 13, and the plurality of first joining plates 14 are respectively bent along the first bending lines 18 to form a box body. The second substrate 31, the two second side plates 32, the second extending plate 33, and the plurality of second joining plates 34 are respectively bent along the second bending lines 38 to form a cover body. Thus, an accommodation space is formed to accommodate the object 5.

The packaging carton box structure according to the present invention is easily assembled and conveniently wraps objects. After wrapping an object, the packaging carton box structure is placed on a placement plane. Then, the first side plates are torn along the pre-tearing portions, and the first substrate or the second substrate is opened outwards and unfolded. The user is enabled to take out the object having a large volume and being heavier along a direction parallel to the placement plane, thereby solving the problems in the prior art that when a packaging carton box is used to package an object having a large volume and being heavier, the object having the large volume and being heavier cannot be taken out unless the object is strenuously uplifted or the forces are applied by many people cooperatively.

While the present invention has been described by the way of example and in terms of the preferred embodiments, it is to be understood that the invention is not limited to the disclosed embodiments. To the contrary, it is intended to cover various modifications and similar arrangements. Therefore, the scope of the appended claims should be accorded the broadest interpretation so as to encompass all such modifications and similar arrangements.

What is claimed is:

1. A packaging carton box structure, comprising:

a first sheet, comprising:

a first substrate, having two first side edges and two second side edges;

two first side plates, respectively connected to the first side edges, the first side plates being respectively bent to form inserting portions, and an outer side of each of the first side plates comprises a pre-tearing portion;

two first extending plates, respectively connected to the second side edges; and a plurality of first joining plates, connected to the first extending plates, the first extending plates being bent towards the first substrate, the first joining plates being respectively inserted into the inserting portions; and a second sheet, comprising:

a second substrate, having two third side edges and two fourth side edges; and two second extending plates, respectively connected to the fourth side edges, the second extending plates being bent towards the second substrate, and respectively positioned on the first extending plates, such that the second sheet covering the first sheet to form an accommodation space, wherein when the pre-tearing portions are torn off, the first joining plates are released from the inserting portions, so as to unfold the first sheet.

2. The packaging carton box structure according to claim 1, further comprising: a plurality of first bending lines, located between the first substrate and the first side plates, between the first substrate and the first extending plates, and between the first extending plates and the first joining plates.

3. The packaging carton box structure according to claim 1, further comprising: a plurality of second joining plates, connected to the second extending plates, wherein the second joining plates are respectively inserted into the inserting portions after the second extending plates are bent towards the second substrate.

4. The packaging carton box structure according to claim 3, further comprising: two second side plates, respectively connected to the third side edges, wherein the second side plates are bent towards the second substrate.

5. The packaging carton box structure according to claim 4, further comprising: a plurality of second bending lines, located between the second substrate and the second side plates, between the second substrate and the second extending plates, and between the second extending plates and the second joining plates.

6. The packaging carton box structure according to claim 1, further comprising: a holding portion, located on the second extending plate.

7. The packaging carton box structure according to claim 1, wherein the first substrate comprises a plurality of openings, the first side plates further comprise a plurality of protruding portions, and the protruding portions are respectively embedded into the openings after the first side plates are bent.

8. The packaging carton box structure according to claim 1, wherein the second extending plates are positioned on the first extending plates in an adhesion manner.

9. A packaging carton box structure, comprising:

a first substrate, having two first side edges and two second side edges;

two first side plates, respectively connected to the first side edges, the first side plates being respectively bent to form inserting portions, and an outer side of each of the first side plates comprises a pre-tearing portion;

two first extending plates, respectively connected to the second side edges;

a plurality of first joining plates, connected to the first extending plates, the first extending plates being bent towards the first substrate, the first joining plates being respectively inserted into the inserting portions;

a second substrate, connected to the first extending plates, and comprising two third side edges and two fourth side edges; and a second extending plate, connected to the fourth side edges opposite to the first extending plates connected to the second substrate, the second extending plate being bent towards the second substrate, and respectively positioned on the first extending plate, such that the second substrate, the second extending plate, and the first extending plates covering the first substrate to form an accommodation space, wherein when the pre-tearing portions are torn off, the first joining plates are released from the inserting portions.

10. The packaging carton box structure according to claim 9, further comprising: a plurality of first bending lines, located between the first substrate and the first side plates, between the first substrate and the first extending plates, and between the first extending plates and the first joining plates.

11. The packaging carton box structure according to claim 9, further comprising: a plurality of second joining plates, connected to the second extending plate, wherein the second joining plates are respectively inserted into the inserting portions after the second extending plate is bent towards the second substrate.

12. The packaging carton box structure according to claim 11, further comprising: two second side plates, respectively connected to the third side edges, wherein the second side plates are bent towards the second substrate.

13. The packaging carton box structure according to claim 12, further comprising: a plurality of second bending lines, located between the second substrate and the second side plates, between the second substrate and the second extending plate, and between the second extending plate and the second joining plates.

14. The packaging carton box structure according to claim 9, further comprising: a holding portion, located on the second extending plate.

15. The packaging carton box structure according to claim 9, wherein the first substrate comprises a plurality of openings, the first side plates further comprise a plurality of protruding portions, and the protruding portions are respectively embedded into the openings after the first side plates are bent.

* * * * *